US007564336B2

(12) United States Patent
Derks

(10) Patent No.: US 7,564,336 B2
(45) Date of Patent: Jul. 21, 2009

(54) SURFACE MOUNT MAGNETIC CORE WITH COIL TERMINATION CLIP

(75) Inventor: William J. Derks, Wellington, FL (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 10/926,755

(22) Filed: Aug. 26, 2004

(65) Prior Publication Data

US 2006/0044104 A1 Mar. 2, 2006

(51) Int. Cl.
*H01F 27/24* (2006.01)

(52) U.S. Cl. ..... 336/229

(58) Field of Classification Search ..... 336/229
See application file for complete search history.

(56) References Cited

U.S. PATENT DOCUMENTS

| | | | | | |
|---|---|---|---|---|---|
| 2,592,721 | A * | 4/1952 | Mott | 336/213 |
| 2,865,086 | A * | 12/1958 | Whipple | 29/605 |
| 3,585,553 | A | 6/1971 | Muckelroy et al. | |
| 3,691,497 | A | 9/1972 | Bailey et al. | |
| 4,199,744 | A | 4/1980 | Aldridge et al. | |
| 4,394,636 | A * | 7/1983 | Hiraku et al. | 336/172 |
| 4,536,733 | A * | 8/1985 | Shelly | 336/182 |
| 4,611,092 | A * | 9/1986 | Pederson et al. | 174/52.2 |
| 4,777,461 | A | 10/1988 | Sakamoto | |
| 5,165,162 | A | 11/1992 | Charles | |
| 5,331,729 | A | 7/1994 | Moorehead | |
| 5,400,005 | A | 3/1995 | Bobry | |
| 5,519,581 | A | 5/1996 | Liepe | |
| 5,877,666 | A | 3/1999 | Johnson et al. | |
| 6,042,683 | A | 3/2000 | Hagn | |
| 6,246,311 | B1 * | 6/2001 | Finnemore et al. | 336/192 |
| 6,292,081 | B1 | 9/2001 | Armfield et al. | |
| 6,492,893 | B2 | 12/2002 | De Graaf | |
| 6,570,478 | B2 | 5/2003 | Meeks | |
| 6,621,397 | B2 | 9/2003 | Hsu | |
| 6,680,664 | B2 * | 1/2004 | Fan | 336/83 |
| 6,819,214 | B2 * | 11/2004 | Elliott et al. | 336/229 |

* cited by examiner

*Primary Examiner*—Elvin G Enad
*Assistant Examiner*—Joselito Baisa
(74) *Attorney, Agent, or Firm*—Armstrong Teasdale LLP

(57) ABSTRACT

A core assembly for a surface mount electronic component includes a core fabricated from a magnetic permeable material and having a top surface, a bottom surface, and an outer side surface interconnecting the top and bottom surfaces. At least one coil termination clip is attached to the core, and the clip extends over at least two of the top surface, bottom surface, and outer side surfaces.

23 Claims, 4 Drawing Sheets

SURFACE MOUNT MAGNETIC CORE WITH COIL TERMINATION CLIP

BACKGROUND OF THE INVENTION

This invention relates generally to manufacturing of surface mount electronic components including magnetic cores, and more specifically to manufacturing of surface mount electronic components having magnetic cores with wire coils.

Manufacturing processes for electrical components have been scrutinized as a way to reduce costs in the highly competitive electronics manufacturing business. Reduction of manufacturing costs are particularly desirable when the components being manufactured are low cost, high volume components. In a high volume component, any reduction in manufacturing costs is, of course, significant. Manufacturing costs as used herein refers to material cost and labor costs, and reduction in manufacturing costs is beneficial to consumers and manufacturers alike.

A variety of electrical components such as transformers and inductors include at least one winding disposed about a magnetic core. For example, at least one type of inductor includes a conductive wire coil wrapped around a toroid-shaped ferromagnetic core, and each end of the coil includes a lead for coupling the inductor to an electronic circuit. As the size of the component is reduced, and especially for surface mount components, the coil leads can be fragile and difficult to connect to a circuit. Therefore, in one type of inductor, for example, a header assembly is adhesively bonded to the core and the coil leads are wrapped about terminals of the header assembly to facilitate connection of the coils to external circuitry. The header assembly, however, tends to increase the cost and overall size of the electrical component. In an era of ever increasing miniaturization and lower cost electrical components, such a header assembly is undesirable.

Additionally, when the components are used in environments susceptible to mechanical shock and vibration, known magnetic core assemblies may present reliability issues if the fragile electrical connections of the coil are jarred loose. It would be desirable to provide a magnetic core assembly which is better suited for demanding work environments, particularly with respect to shock and vibration.

BRIEF DESCRIPTION OF THE INVENTION

According to an exemplary embodiment, a core assembly for a surface mount electronic component is provided. The core assembly comprises a core fabricated from a magnetic permeable material and comprising a top surface, a bottom surface, and an outer side surface interconnecting the top and bottom surfaces. At least one coil termination clip is attached to the core, and the clip extends over at least two of the top surface, bottom surface, and outer side surfaces.

Optionally, the surface mount electronic component is an inductor, and the core comprises a toroid having a first core half, a second core half and a gap therebetween. The termination clip may comprise a triangular surface configured for mounting to a circuit board.

According to another exemplary embodiment, a surface mount electrical component is provided. The component comprises a ferromagnetic core, at least one preformed termination clip attached to the core and receiving a portion of the core, and a coil wound around the core. The coil comprises at least one lead, and the lead is coupled to the termination clip.

In still another embodiment, a surface mount electrical component is provided. The component comprises a ferromagnetic core and a coil wound around the core, the coil comprising at least one wire lead. At least one preformed termination clip is mounted to the core, and the lead is coupled to the termination clip. The clip comprises a C-shaped conductive piece of material configured to be surface mounted to a circuit board.

DETAILED DESCRIPTION OF THE INVENTION

Figure 1:
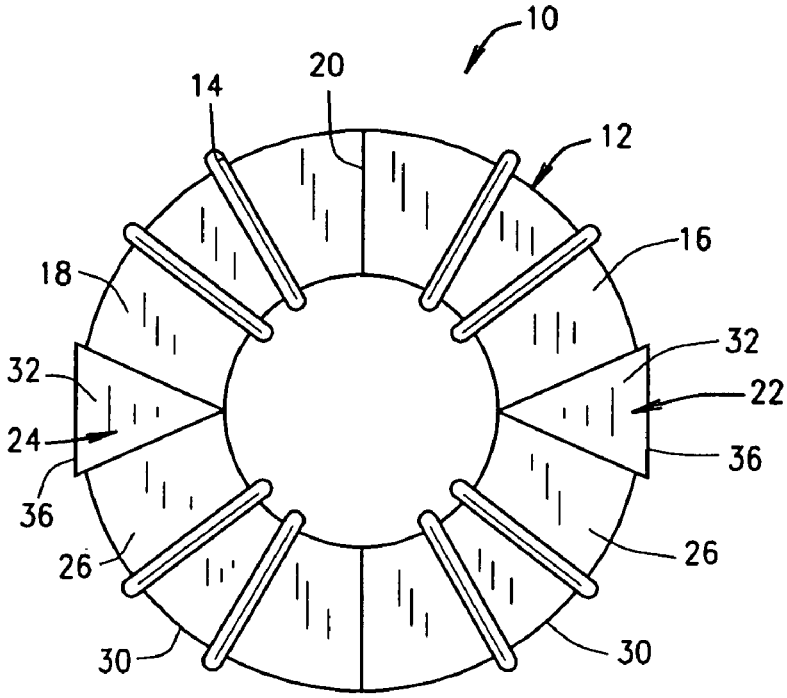
FIG. 1 is a top plan view of a portion of a toroid core and coil assembly according to the present invention.
Figure 2:
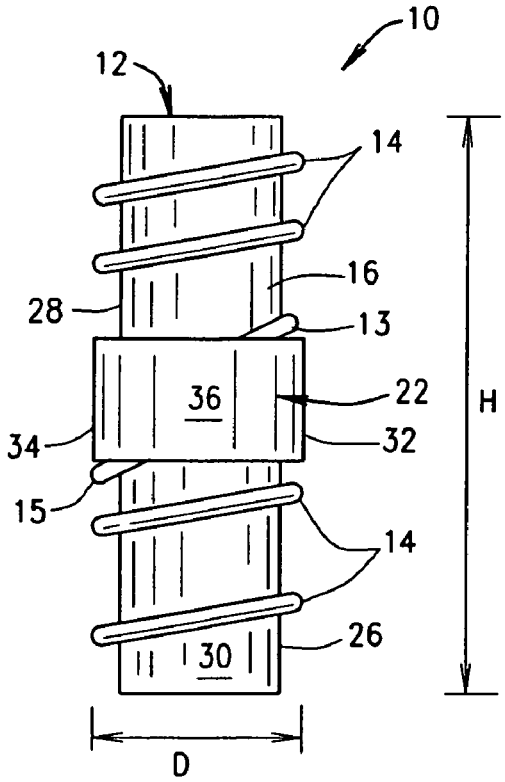
FIG. 2 is a side elevational view of the toroid coil and core assembly shown in FIG. 1.

FIGS. 1 and 2 are a top plan view, and a side elevational view, respectively, of a portion of a toroid core and coil assembly 10 according to an exemplary embodiment of the present invention. In one embodiment, the advantages of core and coil assembly have found particular use in the manufacture of inductor components. It is appreciated, however, that the instant advantages of the present invention are equally applicable to other types of components wherein such core and coil assemblies are employed, such as, for example, transformer components that are widely used in a variety of electronic circuits. Thus, as the benefits of the invention accrue generally to electric components including toroid core and coil assemblies, the description set forth herein is intended for illustrative purposes only and without intention to limit practice of the invention to any particular type of electric component or to any particular end-use application.

Assembly 10 includes a core 12 and a coil 14. Core 12 is fabricated from a known magnetic permeable material, such as ferrite in one embodiment, and includes two substantially similar halves 16, 18 separated by a small gap 20 according to techniques known in the art. Each core half 16, 18 is formed into a toroidal shape familiar to those in the art. In various embodiments, core 12 is fabricated from conductive and non-conductive ferromagnetic materials to meet specified performance objectives. In further embodiments, core 12 may be of other shapes familiar to those in the art, including but not limited to E-shaped cores and rectangular cores while achieving the advantages of the instant invention.

Coil 14, in one embodiment, is fabricated from a known conductive material and includes a number of turns extending over and wrapped around the surfaces of coil halves 16, 18 to achieve a desired effect, such as, for example, a desired inductance value for a selected end use application of coil and core assembly 10. In an illustrative embodiment, coil 14 is formed from a conductive wire according to known techniques and includes a first lead 13 and a second lead 15 (FIG. 2) at opposite ends thereof. As those in the art will appreciate, an inductance value of the core and coil assembly 10, depends primarily upon a number of turns of wire in the coil 14 and the manner in which the coil turns are distributed on the coil halves 16, 18. Secondarily, the type of wire used to form the coil 14 and the wire diameter may influence an inductance value of the core and coil assembly. As such, inductance ratings of the core and coil assembly 10 may be varied considerably for different applications by varying the number of coil turns, the arrangement of the turns, the wire type and the wire diameter.

In accordance with known methods and techniques, wire used to form coil 14 may be coated with enamel coatings, polyeurethane nylon coatings, polyester coatings, and the like to improve structural and functional aspects of coil 14 and to improve reliability of the coil 14.

In an exemplary embodiment, the core 12 includes conductive termination clips 22 and 24 coupled to each respective core half 16, 18 to facilitate connections of the coil leads 13, 15 of the coil 14. In an illustrative embodiment, the termination clips 22 and 24 are fabricated from a conductive material and are formed to wrap around three edges of the core, namely a top edge or surface 26 of each core half 16 and 18, a bottom edge or surface 28 (FIG. 2) of each core half 16 and 18, and an outer side edge or side surface 30 of each core half 16 and 18. The bottom surface 26 and the top surface 28 are substantially parallel to one another in an exemplary embodiment, and the side surface 30 extends substantially perpendicular to the top and bottom surfaces 26 and 28 along an arc of each core half 16 and 18. Each termination clip 22 and 24 includes a top side 32, a bottom side 34, and an outer side 36 extending between the top and bottom sides 32 and 34, and the sides 32, 34, 36 correspond to the surfaces 26, 28, 30 of the core halves 16, 18.

In an illustrative embodiment, the clips 22 and 24 include substantially flat and substantially triangular top and bottom sides 32 and 34, while the outer side 36 is substantially rectangular. The bottom side 34 of the clips 22 and 24 may be surface mounted to a circuit board (not shown in FIG. 1) without affecting an overall height H or depth D of the assembly 10. A lower profile component is therefore provided in comparison to cores having external header assemblies for terminating a wire coil. The triangular sides 32 and 34 of the clips 22 reduce an amount of material in the clips 22 and 24 while providing an adequate area for surface mounting and adequate room for the windings of the coil 14 on the surfaces of the core halves 16 and 18. While the triangular sides 32 and 34 of the clips 22 and 24 are believed to be advantageous, it is recognized that other geometric shapes and configurations of clips 22 and 24 may be employed in alternative embodiments without departing from the scope of the present invention.

Additionally, while the termination clips 22 and 24 are illustrated in an approximately centered position with respect to each core half 16, 18, the termination clips 22 and 24 may be located elsewhere on the core halves 16, 18 as desired without departing from the scope of the present invention.

The termination clips 22 and 24 simplify connection of the coil 14 to the core 12 by eliminating the use of conventional external coil termination components. The wire leads 13 and 15 of the coil are directly terminated to the respective clips 22 and 24 in a known manner (e.g. soldering), and the bottom side 34 of the clips 22 and 24 is surface mounted to a circuit board to complete an electrical connection through the coil 14. As such, material costs and assembly costs of core and coil assembly 10 are reduced in comparison to known toroid core and coil assemblies, thereby reducing overall manufacturing costs. These costs, of course, can be especially significant when core and coil assembly 10 is employed in high volume, surface mount applications.

In a further embodiment, insulating material (not shown in FIG. 1) may be employed to insulate terminations to the clips 22, 24 on each of the core halves 16, 18, as desired. It is contemplated that additional components, such as protective shields, may be employed with core and coil assembly 10 as desired or as necessary for particular end use applications. Such shields and components, for example, may be employed to contain an electromagnetic field of the core and coil assembly in use, and to reduce the effect of the field on the ambient environment As details of these components are believed to be within the purview of those in the art and generally beyond the scope of the present invention, further discussion of these components is omitted.

While the illustrated embodiment includes one winding 14 and two termination clips 22 and 24 connecting the respective leads 13 and 15 of the coil 14, in alternative embodiments, it is contemplated that more than one winding and more than two termination clips could be employed while achieving the benefits of the instant invention. For example, a primary winding and a secondary winding could be employed with respective pairs of termination clips to facilitate connection of leads of the primary winding and the secondary winding. With appropriate selection of the number of turns of the primary and secondary windings in such an embodiment, a step-up or step-down transformer, for example, is provided with reduced manufacturing costs. It is understood that further components neither described nor depicted herein may be employed as needed or as desired to provide an acceptable transformer for particular applications. As details of these components are also believed to be within the purview of those in the art and generally beyond the scope of the present invention, further discussion of these components is omitted.

Figure 3:
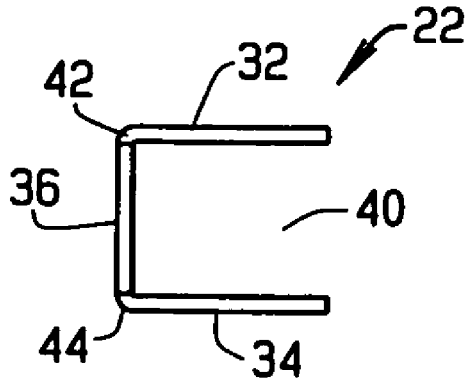
FIG. 3 is a side elevational view of a termination clip for the assembly shown in FIGS. 1 and 2.

FIG. 3 is a side elevational view of the termination clip 22 illustrating the top side 32, the bottom side 34, and the outer side 26 arranged in a C-shaped configuration wherein the top and bottom sides 32 and 34 extend generally parallel to one another and the outer side 36 extends generally perpendicular to the top and bottom sides 32 and 34. The top and bottom sides 32 and 34 extend from opposite ends of the outer side 36 and define a channel 40 therebetween which is dimensioned to receive the outer side surface 30 of the core 12 (shown in FIGS. 1 and 2). In one embodiment, the clip 22 is fabricated from a flat sheet of conductive material, such as a sheet of metal or metal alloy familiar to those in the art, and the sheet is bent, folded or otherwise formed into the shape illustrated in FIG. 3. That is, the sheet is formed to include a first bend 42 and second bend 44 which are each substantially 90° and the sides 32, 34, and 36 of the clip 22 are substantially flat and planar. In one embodiment, the clips 22 may be preformed at a separate stage of manufacture from the core 12 and provided upon the core 12 at a separate assembly stage of manufacture.

The clip 24 in en exemplary embodiment is fabricated in a substantially identical form to the clip 22, although in an alternative embodiment the clips 22 and 24 may be differently configured if desired.

Figure 4:
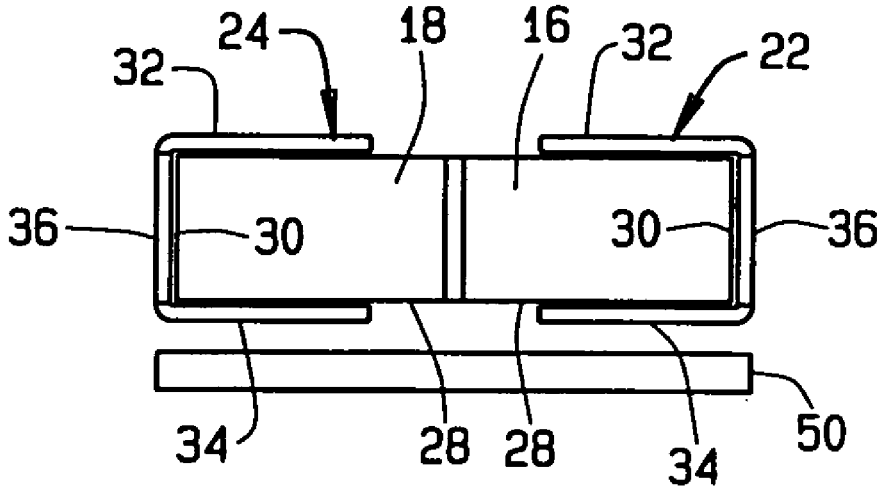
FIG. 4 is a side schematic view a portion of the assembly shown in FIGS. 1 and 2.

FIG. 4 illustrates the clips 22 and 24 attached to the respective core halves 16 and 18. The outer side edges 30 of the core halves 16, 18 are received in the channel 40 between the top sides 32 and the bottom sides 24 of the respective clips 22 and 24. The outer side 36 of the clips 22 and 24 extends alongside the outer side 30 of the respective core halves 16 and 18. The sides 32, 34 and 36 of the clips 22 and 24 wrap around the core halves 16 and 18 and enclose a portion of the respective core halves 16 and 18. In an exemplary embodiment, the bottom side 34 of the clips 22 and 24 are fixedly mounted to the bottom side 28 of the core with an adhesive to maintain the clips in position with respect to the core halves 16 and 18. In alternative embodiments, it is understood that the top side 32 or the outer side 36 of the clips could be adhered to the core halves 16 and 18 in lieu of the bottom side 34, and it is further contemplated that more than one side of the clips 22 and 24 may be mounted to the core halves 16 and 18. The wrap around clips 22 and 24 are believed to improve the reliability of the assembly 10 when subjected to environments wherein mechanical shock and vibration may be expected, such as in, for example, vehicle applications.

The bottom side 34 of the clips 22 and 24 is flat and smooth and is well suited for surface mounting to a circuit board 50. The bottom side 34 of the clips 22 and 24 are electrically connected to conductive circuit traces (not shown) on the circuit board 50, and when the wire leads 13 and 15 (FIG. 2) are electrically connected to the termination clips 22 and 24, an electrical path through the winding of the coil 14 is completed.

It is contemplated that the top side 32 of the clips 22 and 24 may likewise be surface mounted to the circuit board 50 due to the symmetrical formation of the clips 22 and 24. As such, particular manipulation of core halves 16 and 18 (e.g. right side up or upside down position with respect to the circuit board) of the assembly 10 during surface mounting procedures may be avoided. Optionally, however, and in alternative embodiments, one of the top and bottom sides 32 and 34 of the clips 22 and 24 may be eliminated, in which case the clips 22 and 24 would require a particular orientation with respect to the circuit board 50 for correct installation.

Figure 5:
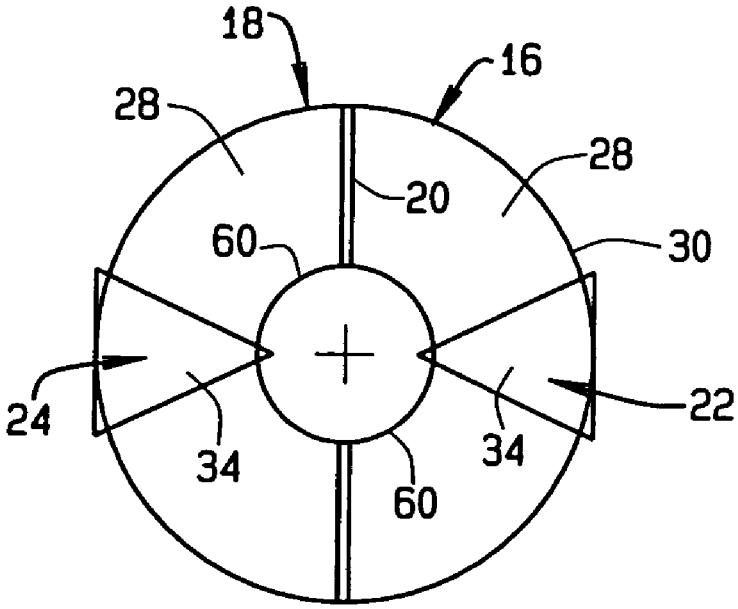
FIG. 5 is a bottom plan view of the assembly shown in FIG. 4.

FIG. 5 illustrates the bottom surface 28 of the core halves 16 and 18 with the termination clips 22 and 24 attached. The bottom side 34 of the clips 22 and 24 extends over the bottom surface 28 of the core halves 16 and 18, and in an exemplary embodiment the bottom side 34 extends completely from the outer side surface 30 of the core halves 16 and 18 to an inner side surface 60 of the core halves 16 and 18. In an alternative embodiment, the bottom side 34 may extend for less than the distance between the inner side surface 60 and the outer side surface 28 of the core halves 16 and 18 Further, the bottom side 34 of the clips 22 and 24 are triangular in shape and substantially identical in size and shape to the top side 32 (FIG. 1), although they not be identically sized and shaped in alternative embodiments.

The core halves 16 and 18 are gapped in a known manner to form the gap 20 therebetween, and the coil 14 is wound around the core halves 16 and 18. The termination clips 22 and 24 may be attached to the respective core halves 16 and 18 before or after winding of the coil 14, and the coil leads 13 and 15 (FIG. 2) may be trapped, pinched, pinned or otherwise retained between one of the sides of the clips 22 and 24 and the outer surfaces of the core halves 16 and 18, such as between the outer side 30 of the core and the outer side 36 of the clips 22 and 24 as shown in FIG. 1. Such mechanical retention of the leads 14 and 15 prevents the leads 13 and 15 from jarring loose in instances of shock or vibration in the vicinity of the component. The leads 13, 15 may further be terminated to the clips 22 and 24 with, for example, a known soldering operation to securely establish an electrical connection between the leads 13, 15 and the respective clips. The clips 22 and 24 are then mounted to the circuit board 50 to complete the connection through the coil 14.

The termination clips 22 and 24 may be provided at low cost and may be simply attached to the core halves 16 and 18 to provide a convenient, low profile, electrical connector. A low profile toroid core and coil assembly is therefore provided with a simplified construction and reduced manufacturing costs, and which better withstands rugged operating environments including shock and vibration.

Figure 6:
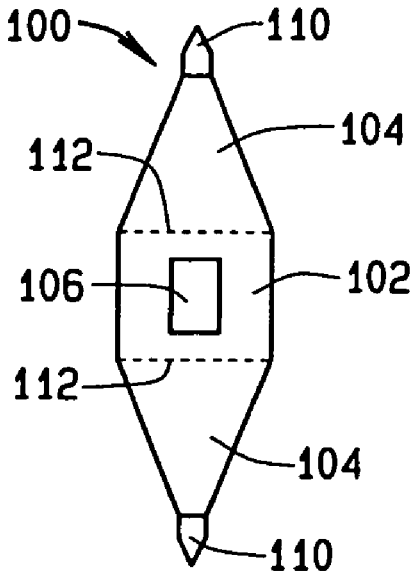
FIG. 6 is a top plan view of another embodiment of a termination clip according to the present invention at a first stage of manufacture.
Figure 7:
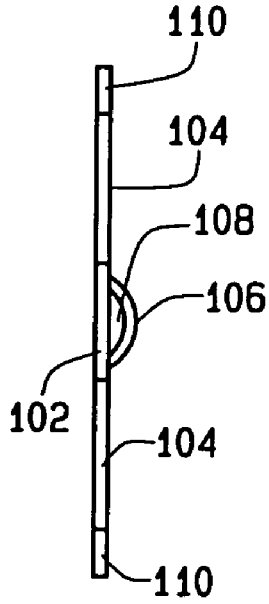
FIG. 7 is a side elevational view of the termination clip shown in FIG. 6.

FIGS. 6 and 7 are a top plan view, and a side elevational view, respectively, of another embodiment of a coil termination clip 100 according to the present invention at a first stage of manufacture. The coil termination clip 100 may be used, for example, in lieu of the termination clips 22, 24 (shown and described in relation to FIGS. 1-5) in core and coil assemblies of electronic components.

Figure 8:
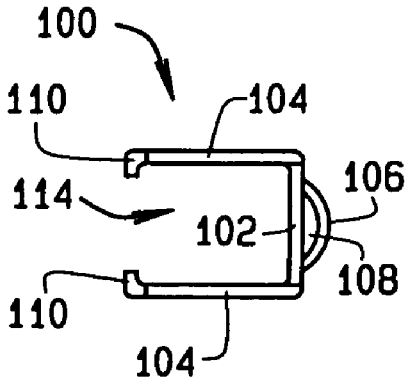
FIG. 8 is a side elevational view of the termination clip shown in FIGS. 6 and 7 at a second stage of manufacture.

Like the termination clips 22 and 24, the termination clip 100 is formed from a conductive metal or metal alloy into a generally planar configuration having a center section 102 and triangular shaped end sections 104 extending from opposite sides of the center section 102. Unlike the termination clips 22 and 24, however, the center section 102 includes a coil clamp section 106 formed therein which is outwardly bowed or projected from the plane of the center section 102. The clamp section 106 may be formed via a known process, such as punching process or other technique familiar to those in the art. The clamp section 106 defines an opening 108 (FIG. 7) which may receive and retain a coil wire lead, such as the leads 13, 15 (shown in FIG. 2). As such, the clamp section 106 may mechanically retain the wire conductor of the coil and prevent disengagement of the wire lead from the clip 100 during high temperature soldering operations. Depending on the diameter of wire used to form the coil and a temperature of the soldering operation, the wire may become semi-rigid and would otherwise spring loose from the clip 100 if the clamp section 106 were not present to retain the wire lead in place while the solder is in a liquid state Additionally, and as shown in FIGS. 7 and 8, the clip 100 includes mounting feet 110 projecting outwardly from the distal ends of the end sections 104. The mounting feet are also triangular in shape on their leading ends and may serve to enhance and anchor the termination clip to a core, such as the core halves 16, 18 shown and described above.

While the termination clip 100 is illustrated in a specific shape in FIGS. 7 and 8, it is understood that various geometric shapes may be employed in the center section 102, the end sections 104, the clamp section 106 and the mounting feet 110 in different embodiments. That is, the particular clip 100 illustrated in FIGS. 7 and 8 is provided for exemplary purposes only, and the particular combinations of triangular shapes, for example, need not be included in alternative embodiments.

FIG. 8 is a side elevational view of the termination clip 100 shown in FIGS. 6 and 7 at a second stage of manufacture wherein the end sections 104 are folded, bent or otherwise shaped at formation lines 112 (shown in phantom in FIG. 6) such that the end sections 104 extend substantially perpendicular from the center section 102, thereby imparting a C-shaped configuration to the clip 100. The triangular end sections 104 are suited for surface mounting to a circuit board when installed.

A channel 114 is defined between the end sections 104 wherein a portion of a core half 16, 18 may be received in the channel 114 when the clip 100 is installed. Portions of the mounting feet 110 are folded, bent, or otherwise shaped to extend from the end sections 104 into the channel 114, thereby providing a resilient clamping effect when the clip 100 is installed to a core half 16, 18. Alternatively, the mounting feet 110 may be fitted over the inner edge of the core halves 16, 18 to anchor the clip 100 to the core.

The clamp section 108 extends outwardly from the center section 106 and when a coil lead 13 or 15 (FIG. 2) is received in the opening 108 formed by the clamp section 106, the coil lead is retained in contact with the clip 100 during soldering operations to ensure a reliable electrical connection.

The termination clip 100 may be provided at low cost and may be simply attached to the core halves 16 and 18 to provide a convenient, low profile, electrical connector. A low profile toroid core and coil assembly is therefore provided with a simplified construction and reduced manufacturing costs, and which better withstands rugged operating environments including shock and vibration.

While the invention has been described in terms of various specific embodiments, those skilled in the art will recognize that the invention can be practiced with modification within the spirit and scope of the claims.

What is claimed is:

1. A core assembly for a surface mount electronic component, said core assembly comprising:

a core that comprises a magnetic permeable material, a top surface, a bottom surface, and an outer side surface connecting said top and bottom surfaces;

a wire coil wrapped around the core a number of turns; and at least one coil termination clip attached to said core via a resilient clamping effect, said at least one coil termination clip extending over said top surface, said bottom surface, and said outer side surface, wherein said wire coil is terminated to said at least one coil termination clip and wherein said at least one coil termination clip defines a conductive path to the wire coil;

wherein said core comprises a toroid that comprises an inner surface opposite said outer side surface and also connecting said top surface and said bottom surface, and wherein said at least one coil termination clip further comprises pointed mounting feet embracing the inner surface.

2. A core assembly in accordance with claim 1, further comprising epoxy disposed between said bottom surface and said at least one coil termination clip.

3. A core assembly in accordance with claim 1 wherein said core comprises a first core half, a second core half and a gap therebetween, said at least one termination clip located on one of said first core half and said second core half.

4. A core assembly in accordance with claim 1 wherein said at least one termination clip comprises a triangular surface configured for mounting to a circuit board.

5. A core assembly in accordance with claim 1, wherein said at least one coil termination clip wraps around each of said top surface, said bottom surface, and said outer side surface.

6. A core assembly in accordance with claim 1, wherein said at least one coil termination clip comprises a conductive sheet of material bent into a desired shape, wherein the conductive sheet comprises:

a rectangular section facing said outer side surface;

a first tapered section, connected to a first side of said rectangular section, facing said top surface; and a second tapered section, connected to a second side of said rectangular section, facing said bottom surface.

7. A core assembly in accordance with claim 6 wherein said rectangular section is square.

8. A surface mount electrical components comprising:

a core and coil assembly comprising:

a toroid-shaped ferromagnetic core having a top surface, a bottom surface, an outer side surface connecting said top and bottom surface and an inner surface opposite said outer side surface, said inner surface connecting said top and bottom surface;

at least one termination clip extending over said outer surface and embracing said toroid-shaped ferromagnetic core via a clamping effect, said at least one termination clip comprising pointed mounting fret embracing the inner surface; and a coil wound around said core, said coil comprising at least one lead, said at least one lead electrically and mechanically coupled to said at least one termination clip, the termination clip in surface engagement with said core and defining a current path to the coil.

9. A surface mount electrical component in accordance with claim 8 wherein said at least one termination clip comprises a surface configured for surface mounting to a circuit board.

10. A surface mount electrical component in accordance with claim 9 wherein said surface is substantially triangular in shape.

11. A surface mount electrical component in accordance with claim 8, wherein said at least one termination clip comprises a sheet of metal bent to generally comply with said outer side surface, said top surface and said bottom surface, and wherein said sheet comprises:

a generally rectangular section, having first and second sides opposite one another;

a first generally triangular section extending from the first side to a first pointed section; and a second generally triangular section extending from the second side to a second pointed section.

12. A surface mount electrical component in accordance with claim 11, wherein said at least one termination clip defines a channel, and wherein said generally rectangular section is square.

13. A surface mount electrical component in accordance with claim 12 wherein said at least one termination clip comprises a clamp section formed therein, said clamp section comprising an opening in the square configured to receive said at least one lead.

14. A surface mount electrical component comprising:

a ferromagnetic core comprising a top surface, a bottom surface, an inner side surface and an outer side surface;

a conductive coil wound around said core, said coil comprising at least one wire lead; and at least one conductive termination clip, said at least one wire lead coupled to said at least one termination clip, said at least one termination clip comprising a C-shaped plate of conductive material configured to be surface mounted to a circuit board, the C-shaped plate of conductive material including pointed mounting feet;

wherein a resilient clamping effect adheres said at least one termination clip in direct contact with said core and an electrical path is completed through the at least one termination clip to the at least one conductive coil; and wherein the pointed mounting feet embrace the inner side surface of the core.

15. A surface mount electrical component in accordance with claim 14 wherein said core comprises a toroid core, and wherein the C-shaped plate wraps around a surface contour of the toroid core and into a central hole of the toroid core.

16. A surface mount electrical component in accordance with claim 15 wherein said toroid core comprises a first core half, a second core half and a gap in between said first core half and said second core halt and wherein the C-shaped plate comprises a planar surface between two bends.

17. A surface mount electrical component in accordance with claim 14, wherein said C-shaped plate of conductive material defines a channel, and wherein a portion of said core is received in said channel.

18. A surface mount electrical component in accordance with claim 14, wherein said at least one termination clip includes at least one triangular surface configured to be surface mounted to a circuit board, and wherein said at least one triangular surface anchors said at least one termination clip to said core.

19. A surface mount electrical component in accordance with claim 14 wherein said component is an inductor.

20. A surface mount electrical component in accordance with claim 14, wherein said at least one termination clip defines an opening configured to receive said at least one wire lead.

21. A core assembly for a surface mount electronic component, said core assembly comprising:

a core of magnetic permeable material that comprises a top surface, a bottom surface, and an outer side surface connecting said top and bottom surfaces, and an inner side surface connecting said top and bottom surfaces and opposing the outer side surface;

a wire coil wrapped around the core a number of turns; and at least one coil termination clip intimately attached to at least one of said top surface, said bottom surface, and said outer side surface;

wherein the at least one coil termination clip includes pointed mounting feet embracing the inner side surface; and wherein said wire coil is terminated to said at least one coil termination clip and completes an electrical path to the wire coil.

22. A core assembly in accordance with claim 21, wherein said core comprises a first core half a second core half, and a gap between said first core half and said second core half, and wherein said at least one termination clip is located on one of said first core half and said second core half.

23. A core assembly in accordance with claim 21, wherein said at least one coil termination clip wraps around each of said top surface, said bottom surface, and said outer side surface.

* * * * *